US005777565A

United States Patent [19]

Hayashi et al.

[11] Patent Number: 5,777,565

[45] Date of Patent: Jul. 7, 1998

[54] ON-VEHICLE DEVICE FOR ROAD-VEHICLE COMMUNICATION

[75] Inventors: Hironao Hayashi, Gifu-ken; Tomoyuki Watanabe, Toyota, both of Japan

[73] Assignee: Toyota Jidosha Kabushiki Kaisha, Toyota, Japan

[21] Appl. No.: 683,725

[22] Filed: Jul. 18, 1996

[30] Foreign Application Priority Data

Jul. 19, 1995 [JP] Japan ..... 7-182809

[51] Int. Cl.[6] ..... G08G 1/00

[52] U.S. Cl. ..... 340/928; 235/384; 235/375; 395/213

[58] Field of Search ..... 340/928, 933; 235/384, 380, 375; 364/424.04, 423.098, 144, 138; 395/213

[56] References Cited

U.S. PATENT DOCUMENTS

| | | | |
|---|---|---|---|
| 4,930,129 | 5/1990 | Takahira | 371/40.4 |
| 4,963,723 | 10/1990 | Masada | 235/384 |
| 5,038,025 | 8/1991 | Kodera | 235/375 |
| 5,111,030 | 5/1992 | Brasington et al. | 235/375 |
| 5,172,321 | 12/1992 | Ghaem et al. | 364/444 |
| 5,266,785 | 11/1993 | Sugihara et al. | 235/384 |
| 5,310,999 | 5/1994 | Claus et al. | 235/384 |
| 5,521,363 | 5/1996 | Tannenbaum | 235/375 |
| 5,525,991 | 6/1996 | Nagura et al. | 235/384 |
| 5,602,919 | 2/1997 | Hurta et al. | 340/928 X |
| 5,663,548 | 9/1997 | Hayashi et al. | 235/384 |
| 5,710,702 | 1/1998 | Hayashi et al. | 364/423.098 |

FOREIGN PATENT DOCUMENTS

| | | |
|---|---|---|
| 4-311291 | 11/1992 | Japan . |
| 5-100018 | 4/1993 | Japan . |

*Primary Examiner*—Jeffery A. Hofsass
*Assistant Examiner*—Anh La
*Attorney, Agent, or Firm*—Cushman Darby & Cushman IP Group of Pillsbury Madison & Sutro LLP

[57] ABSTRACT

An on-vehicle device for road-vehicle communication includes a communication unit for exchanging information with an on-road device, and storage unit for storing necessary information. When a communication error occurs between the on-vehicle device and the on-road device, information regarding the communication error is stored in the storage unit. The vehicle device further includes a card read-write unit into which a control card is removably inserted. The control card has a storage area for storing the above-described error information and information necessary in the on-vehicle device. Via the card read-write unit, information stored in the storage unit is transferred to the storage area of the control card to be stored therein, and information stored in the storage area of the control card is transferred to the storage unit to be stored therein. Accordingly, when a communication error occurs between the on-vehicle device and the on-road device, information regarding the communication error is transferred from the storage unit to the control card, so that information regarding the communication error can be obtained from the on-road device via the control card.

13 Claims, 12 Drawing Sheets

ON-VEHICLE DEVICE FOR ROAD-VEHICLE COMMUNICATION

BACKGROUND OF THE INVENTION

1. Field of the Invention

The present invention relates to an on-vehicle device for road-vehicle communication, and particularly to an on-vehicle device for road-vehicle communication which communicates with an on-road device disposed along a toll road such as an expressway in order to automatically collect a toll.

2. Description of the Related Art

In recent years, an automatic fee collecting system has been developed which collects a fee for service received at fee-charging facilities, for example, a toll for use of a toll road, using a prepaid or post-payment card. The automatic fee collecting system is composed of an on-road device disposed along a road and an on--vehicle device. The on-road device has an antenna and serves as an inquiring device for requesting a vehicle to provide various kinds of information. The on-vehicle device also has an antenna and serves as an answering device for providing the requested information to the on-road device. The on-vehicle device and the on-road device exchange information via radio communication therebetween, for example, for automatically collecting tolls at entrance gates or exit gates of a toll road.

The automatic fee collecting system suffers various problems. In some cases, the on-road device fails to receive information from the on-vehicle-Le device, or the on-vehicle device fails to receive information from the on-road device, due to poor maintenance of the on-road device, insufficient power generation of a battery installed in a vehicle, malfunction of an antenna, or the like. In some cases, the on-road device fails to receive route information indicative of the route along which a vehicle has traveled, due to an error in the on-vehicle device of a vehicle traveling along a toll road. This disables the system from taking a proper action.

In a conventional system, when the on-road device fails to receive information from the on-vehicle device, the on-vehicle device and the on-road device are directly connected through their connectors so that the on-road device can read information from the on-vehicle device (Japanese Patent Application Laid-Open (JP-A) No. 5-100018).

This conventional system, however, has a problem that the on-vehicle device is required to have a connector for transmitting information to and from the on-road device, resulting in an increased size of the on-vehicle device. Also, when the on-vehicle device and the on-road device for some reason have difficulty in communicating, they must be connected to each other through their connectors so as to transmit information therebetween, resulting in excess work being imposed on a driver of the vehicle or an operator working with the on-road device.

SUMMARY OF THE INVENTION

The present invention has been accomplished to solve the above-mentioned problems. An object of the present invention is to provide an on-vehicle device for road-vehicle communication which allows an on-road device to readily check data stored in the on-vehicle device without an increase in the size of the on-vehicle device.

In order to attain the object described above, according to a first aspect of the present invention, there is provided an on-vehicle device for road-vehicle communication which includes storage means, judging means, identifying means, and processing means, as shown in FIG. 12. The judging means judges whether or not a control card having a storage portion for storing data is inserted into the on-road device. The identifying means identifies whether the inserted control card requests at least either a read of data from the storage means or a write of data into the storage portion of the control card or whether the inserted control card requests at least either a write of data into the storage means or a read of data from the storage portion of the control card. When the control card requests at least either a read of data from the storage means or a write of data into the storage portion of the control card, the processing means reads data from the storage means and writes the read data into the storage portion of the control card. When the control card requests at least either a write of data into the storage means or a read of data from the storage portion of the control card, the processing means reads data from the storage portion of the control card and writes the read data into the storage means.

By reading data from the storage portion of the control card, the on-road device can readily confirm the contents of data stored in the on-vehicle device.

By reading data from the storage portion of the control card and writing the read data into the storage means, the contents of the storage means can be restored to the normal data.

Thus, according to the first aspect, use of the control card allows the on-vehicle device and the on-road device to readily exchange data therebetween without being directly connected to each other.

According to a second aspect of the present invention, the processing means shown in FIG. 12 operates as follows. When the identifying means judges that the inserted control card requests at least either a write of data into the storage means or a read of data from the storage portion of the control card, the processing means performs first processing for reading data from the storage portion of the control card and for writing the read data into the storage means, and then performs second processing for reading data from the storage means and for writing the read data into the storage portion of the control card.

Thus, according to the second aspect, data stored in the control card is written into the storage means, and in addition, the written data is again written into the storage portion of the control card. Accordingly, without directly connecting together the on-vehicle device and the on-road device, the contents of the storage means can be restored to the normal data, and the on-road device can check to see, by reading data from the control card, whether or not data stored in the on-vehicle device is restored normally.

DESCRIPTION OF THE EMBODIMENT

An embodiment of the present invention will now be described in detail with reference to the drawings. The present invention is embodied in an automatic toll collecting system which automatically collects a toll from a vehicle traveling along a toll road. In the automatic toll collecting system, information is transmitted through radio communication between an on-vehicle device and an on-road device having a flat antenna and disposed along a road at an entrance gate, at an exit gate and the like. From the thus transmitted information, the system determines the traveled section (route) along which a vehicle has traveled as well as the type of the vehicle, thereby automatically collecting a corresponding toll without requiring the vehicle to stop at an entrance or exit gate.

Figure 2:
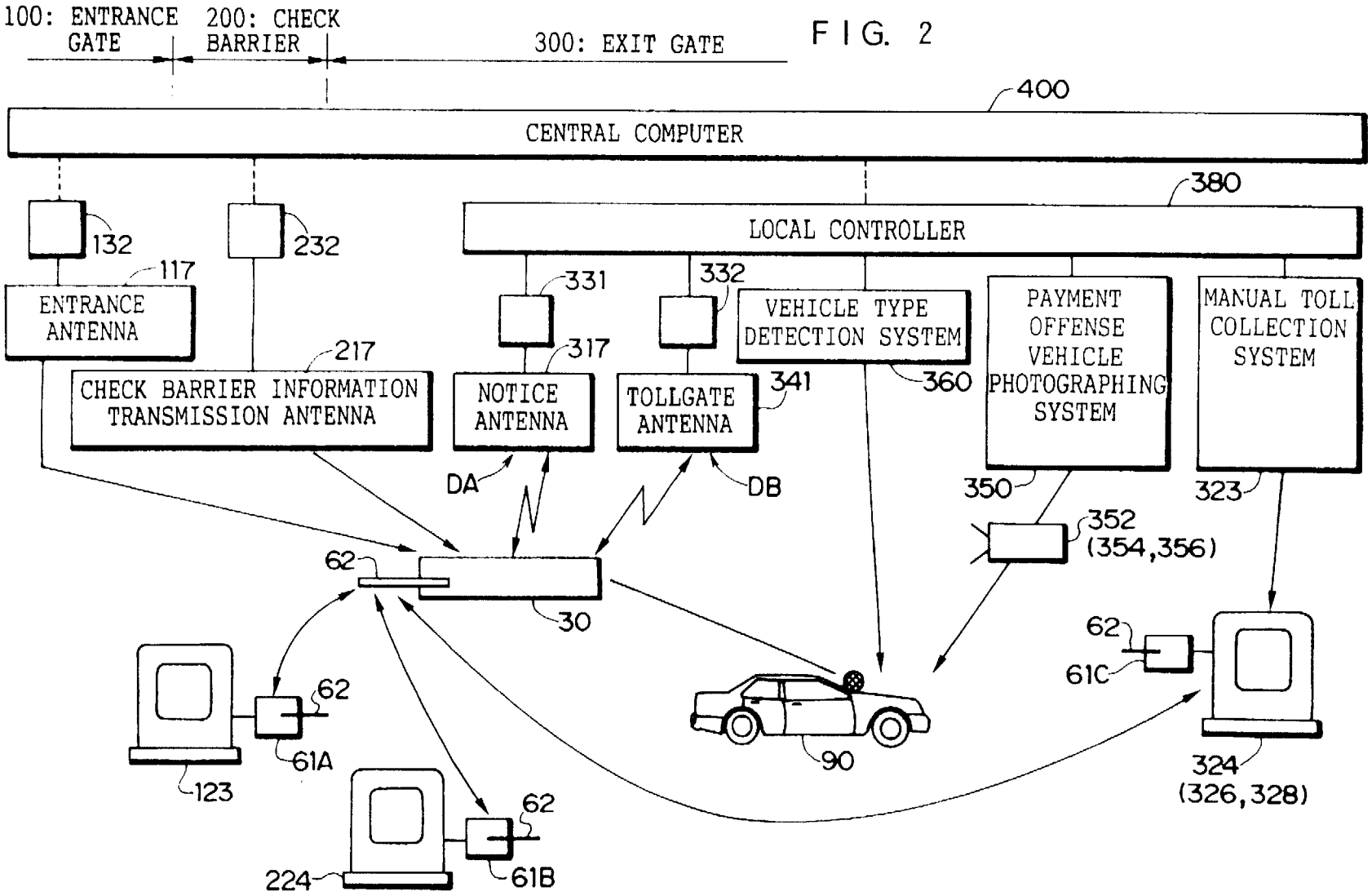
FIG. 2 is a block diagram illustrating an automatic toll collecting system to which the present invention is applicable.

As shown in FIG. 2, an on-vehicle device 30 installed in a vehicle 90 has an IC card read-write unit into which an IC card 62 is removably inserted and which serves as information read-write means.

Examples of the IC card 62 include a general prepaid card, a general post-payment card, and a control card. The general prepaid card contains information regarding the card number, the card value balance, details of use of a toll road (entrance gate number, exit gate number, toll, date, etc.), and the type of card. The general post-payment card contains information regarding the card number, details of use of a toll road, and the type of card. The control card contains information regarding a card number, a R/W flag to specify a write (W) or a read (R), and the type of card, and has a work area whose size is large enough to store all the information stored in the on-vehicle device 30. Each of the general cards contains a certification key code for making correspondence between the card and the on-vehicle device 30. The control card contains either a certification key code similar to that of the general cards or a dual certification key code.

Other types of cards usable in place of the IC card 62 include a memory card such as an LSI card, a magnetic card, a hologram card capable of optically recording and reproducing information, or an magnetooptical card capable of magnetooptically recording and reproducing information.

An on-road device has a flat antenna for exchanging various kinds of information with the on-vehicle device 30 and is disposed along a toll road at each of an entrance gate 100, an intermediate location thereinafter referred to as check barrier) 200, and an exit gate 300.

An entrance antenna 117, which is a flat antenna, is disposed at the entrance gate 100. An entrance antenna control unit 132 is connected to the entrance antenna 117. The entrance antenna control unit 132 transmits information regarding the entrance gate of the toll road to the on-vehicle device 30 through the entrance antenna 117. In addition, a ticket issuing apparatus 123 is disposed at the entrance gate 100 so as to issue a ticket for a vehicle which is not equipped with the on-vehicle device 30 and hence is required to manually pay a toll. As will be described in detail later, when road-vehicle communication does not properly work due to a communication error, the ticket issuing apparatus 123 also serves as a recovery gate for writing the entrance information indicative of the entrance gate 100 into the on-vehicle device 30 and for reading data from the on-vehicle device 30. These operations are performed using a control card. The ticket issuing apparatus 123 has an IC card read-write unit 61A into which the IC card 62 is removably inserted. The IC card read-write unit 61A is connected to a central computer 400. The entrance antenna control unit 132 can be connected to the central computer 400 for collectively controlling vehicles entering the toll road.

A check barrier information transmission antenna 217, which is a flat antenna, is disposed at the check barrier 200. A check barrier information transmission antenna control unit 232 is connected to the check barrier information transmission antenna 217. The check barrier information transmission antenna control unit 232 transmits check barrier information (information regarding passage of a vehicle 90 through a check barrier) to the on-vehicle device 30 installed in the vehicle 90, via the check barrier information transmission antenna 217. The check barrier information indicates the route along which the vehicle 90 has traveled. The check barrier information transmission antenna control unit 232 can be connected to the central computer 400 for collectively controlling traffic. A recovery gate 224 is disposed at the check barrier 200 so as to write into the on-vehicle device 30 via a control card the route information indicative of the check barrier 200 when road-vehicle communication does not work properly due to a communication error. The recovery gate 224 is provided with an IC card read-write unit 61B, into which the IC card 62 is removably inserted. The IC card read-write unit 61B is connected to the central computer 400. The recovery gate 224 may be disposed at a parking or service area.

The above-mentioned entrance information and route information may be codes such as numbers allocated to the respective locations of the toll road.

In order to improve reliability of radio transmission of information, at an exit gate 300 are disposed a notice antenna 317 and a tollgate antenna 341, each of which is a flat antenna. A notice antenna control unit 331 is connected to the notice antenna 317 while a tollgate antenna control unit 332 is connected to the tollgate antenna 341. The notice antenna control unit 331 arid the tollgate antenna control unit 332 are connected to a local controller 380, which can be connected to the central computer 400. The local controller 380 contains a microcomputer so as to control the notice antenna control unit 331, the tollgate antenna control unit 332, and the like, using a built-in program. The notice antenna 317, the tollgate antenna 341, the notice antenna control unit 331, and the tollgate antenna control unit 332 function as an on-road device of the present invention. However, the notice antenna 317 and the notice antenna control unit 331 may be omitted.

Also, at the exit gate 300 are disposed a vehicle type detection system 360, a payment offense vehicle photographing system 350, and a manual toll collection system 323. The vehicle type detection system 360 identifies the type of a vehicle through image processing. The payment offense vehicle photographing system 350 has a camera 352 connected thereto so as to photograph a vehicle which has passed through the exit gate 300 without paying a toll. The manual toll collection system 323 collects a toll from a vehicle from which a toll cannot be automatically collected. The local controller 380 collectively controls these systems so as to cope with any trouble in collection of a toll and to automatically collect a toll in accordance with both a route along which a vehicle has traveled and the type of vehicle. The local controller 380 may be connected to the central computer 400 so as to smoothly and quickly transmit between them a modification in a toll table and information regarding a payment offense vehicle. In addition, by storing in the on-road device information regarding a certification key code of the control card, an attempt to use the control card unlawfully through theft can be prevented.

An example of each of the entrance gate 100, the check barrier 200, and the exit gate 300 mentioned above will next be described in detail.

Figure 3:
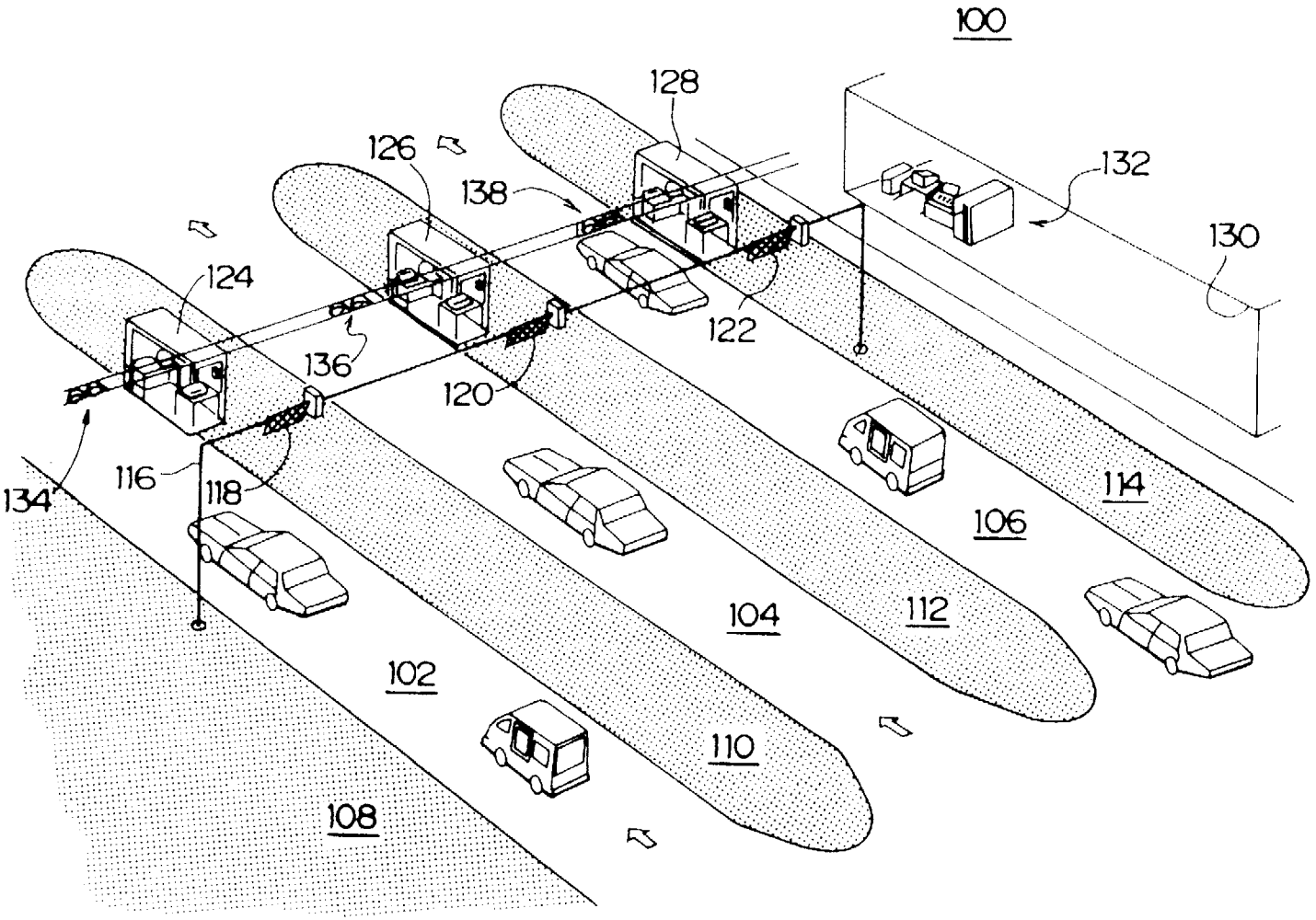
FIG. 3 is a schematic perspective view illustrating an entrance gate of the automatic toll collecting system of FIG. 2.

As shown in FIG. 3, the entrance gate 100 of a toll road has three lanes 102, 104, and 106. The lane 102 is formed between a ground 108 and a separation zone 110, the lane 104 is formed between the separation zone 110 and a separation zone 112, and the lane 106 is formed between the separation zone 112 and a ground 114. An arch 116 is disposed between the ground 108 and the ground 114 such that it extends over these lanes 102, 104, and 106. In addition, entrance antennas 118, 120, and 122 (which correspond to the entrance antenna 117 shown in FIG. 2) are disposed on the arch 116. The entrance antenna 118 is for radio communication with a vehicle traveling along the lane 102 and is located above the lane 102. Likewise, the entrance antenna 120 is for radio communication with a vehicle traveling along the lane 104 and is located above the lane 104. Further, the entrance antenna 122 is for radio communication with a vehicle traveling along the lane 106 and is located above the lane 106.

On the ground 114 is disposed an entrance gate control center 130 equipped with an entrance antenna control unit 132, to which the entrance antennas 11.3, 120, and 122 are connected.

In FIG. 3, three entrance antennas 118, 120, and 122 are used. However, one or two entrance antennas may be used for one or two lanes, or more antennas may be used for one or two lanes.

Ticket issuing apparatuses 124, 126, and 128 (which correspond to the ticket issuing apparatus 123 shown in FIG. 2) are disposed at the entrance gate 100 so as to issue a ticket for passage for a vehicle whose driver pays a toll manually because the vehicle is not equipped for automatic toll collection. The ticket issuing apparatus 124 for the lane 102 is disposed on the separation zone 110 in the vicinity of its downstream end in the vehicle traveling direction, such that it is situated at the side facing the lane 102. Likewise, the ticket issuing apparatus 126 for the lane 104 is disposed on the separation zone 112 in the vicinity of its downstream end in the vehicle traveling direction, such that it is situated at the side facing the lane 104. Further, the ticket issuing apparatus 128 for the lane 106 is disposed on the ground 114 in the vicinity of its downstream end in the vehicle traveling direction, such that it is situated at the side facing the lane 106. These ticket issuing apparatuses 124, 126, and 128 are connected to the entrance gate control center 130.

On the downstream side of the arch 116 in the vehicle traveling direction, traffic signals 1:34, 136, and 138 for the lanes 102, 104, and 106 are disposed so as to indicate whether or not a corresponding lane is available for go. These traffic signals 134, 136, and 13.3 are connected to the entrance gate control center 130 and under control thereof tell a driver (for example, by lighting a green light) that a corresponding lane is available for go or tell a driver (for example, by lighting a red light) that a corresponding lane is not available for go.

The entrance gate control center 130 is connected to the central computer 400 (FIG. 2). The entrance gate control center 130 may be an independent control system without being connected to the central computer 400.

Figure 4:
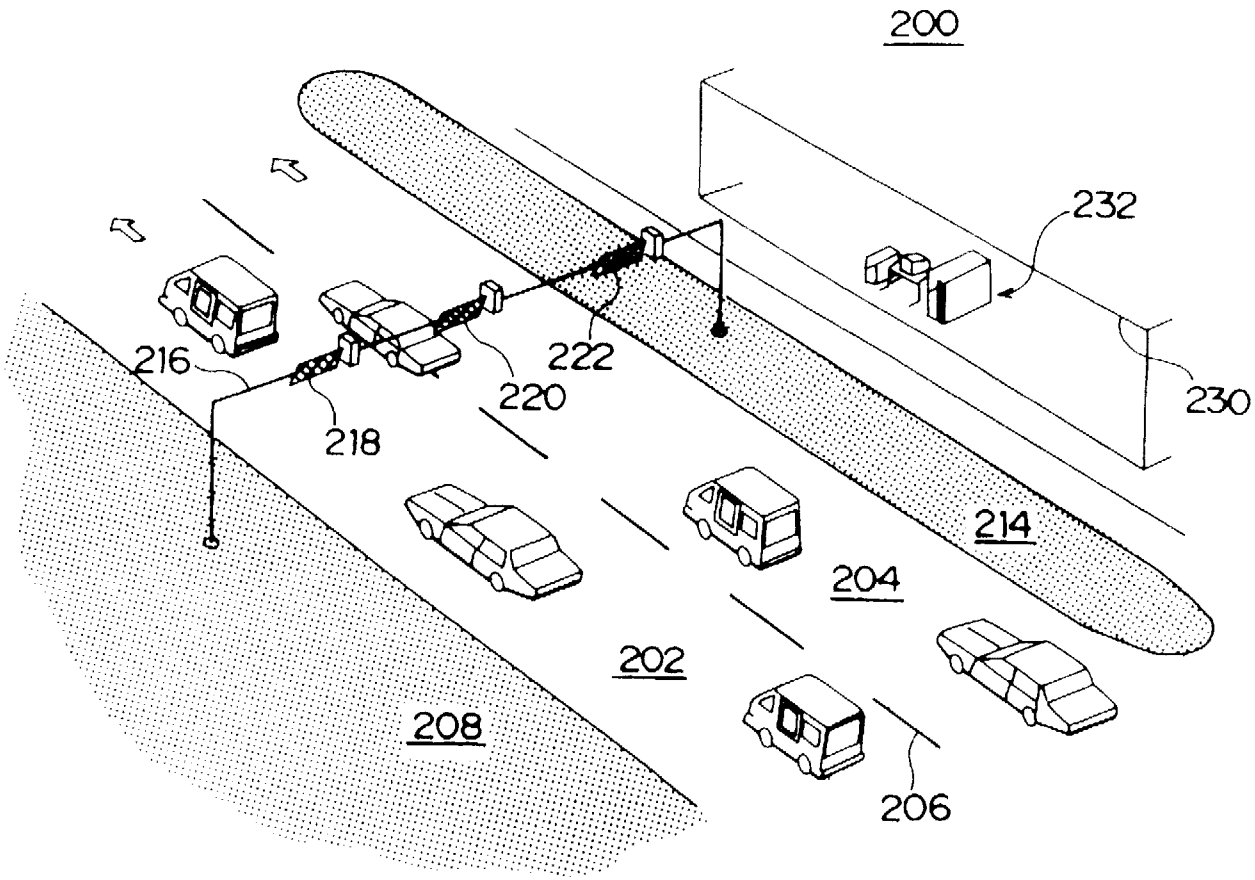
FIG. 4 is a schematic perspective view illustrating a check barrier of the automatic toll collecting system of FIG. 2.

As shown in FIG. 4, at the check barrier 200 located immediately before or after a branching point in a toll road, two lanes 202 and 204 are provided side by side between a ground 208 and a ground 214. An arch 216 is disposed between the ground 208 and the ground 214 such that it extends over the lanes 202 and 204. In addition, check barrier information transmission antennas 218, 220, and 222 (which correspond to the antenna 217 shown in FIG. 2) are disposed on the arch 216. The check barrier information transmission antenna 218 is located above the lane :202 for radio communication with a vehicle traveling along the lane 202. The check barrier information transmission antenna 222 is located above the lane 204 for radio communication with a vehicle traveling along the lane 204. The check barrier information transmission antenna 220 is located at a substantially mid point between the barrier information transmission antennas 218 and 222 such that it is situated above a centerline 206 between the lanes 202 and 204, for radio communication with a vehicle, part of which is in the lane 202 and the rest of which is in the lane 204.

A check barrier control center 230 equipped with the check barrier information transmission antenna control unit 232 is disposed on the ground 214. The check barrier information transmission antennas 218, 220, and 222 are connected to the check barrier information transmission antenna control unit 232.

Figure 5:
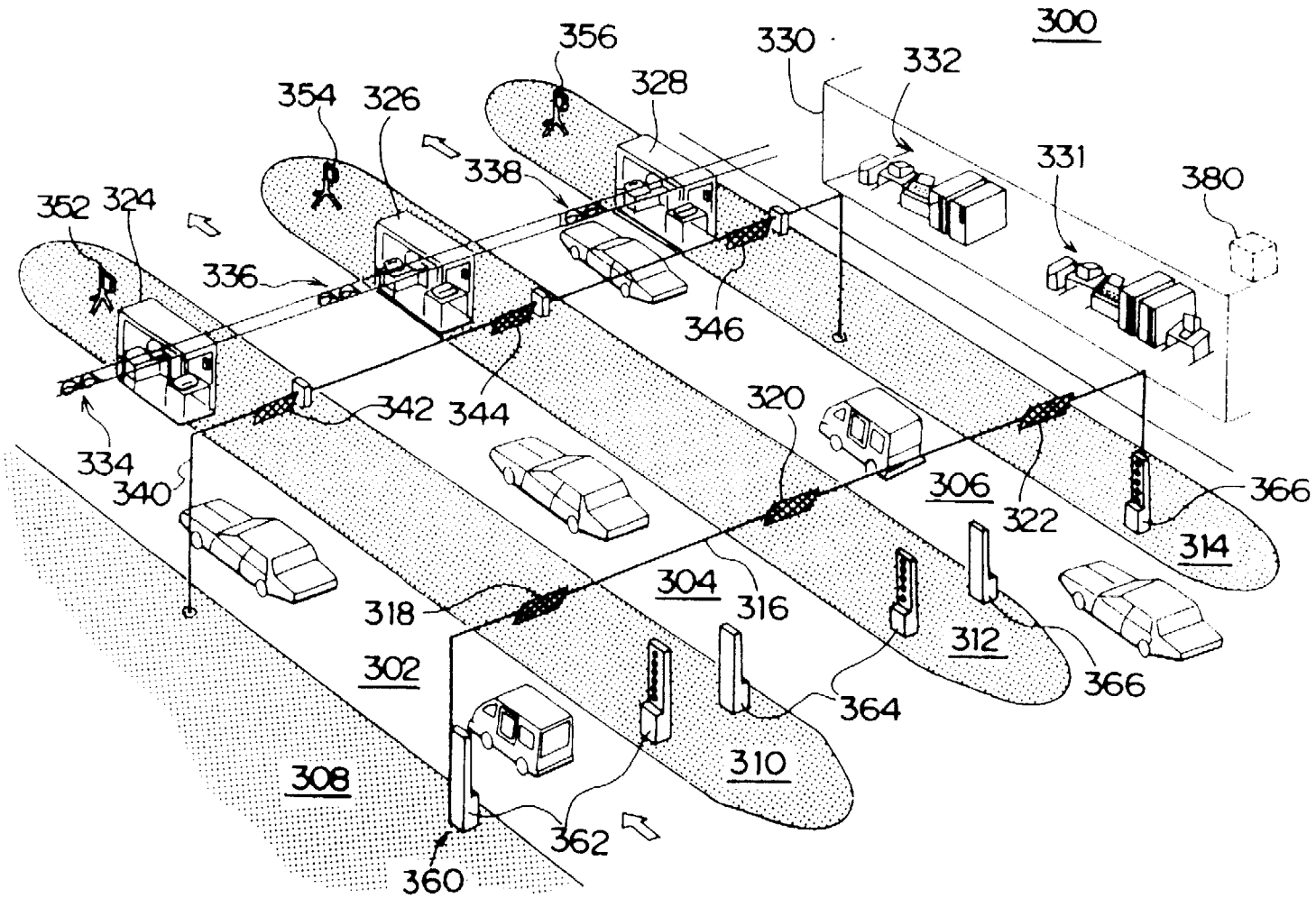
FIG. 5 is a schematic perspective view illustrating an exit gate of the automatic toll collecting system of FIG. 2.

As shown in FIG. 5, the exit gate 300 of the toll road has three lanes 302, 304, and 306. The lane 302 is formed between a ground 308 and a separation zone 310, the lane 304 is formed between the separation zone 310 and a separation zone 312, and the lane 306 is formed between the separation zone 312 and a ground 314.

An arch 316 is disposed between the ground 308 and the ground 314 such that it extends over these lanes 302, 304, and 306. In addition, notice antennas 318, 320, and 322 (which correspond to the notice antenna 317 shown in FIG. 2) are disposed on the arch 316. The entrance antenna 318 is for radio communication with a vehicle traveling along the lane 302 and is located above the lane 302. Likewise, the notice antenna 320 is for radio communication with a vehicle traveling along the lane 304 and is located above the lane 304. Further, the notice antenna 322 is for radio communication with a vehicle traveling along the lane 306 and is located above the lane 306.

An exit gate control center 330 is disposed on the ground 314. The notice antenna control unit 331 and the tollgate antenna control unit 332, which will be described later, are disposed in the exit gate control center 330. The notice antennas 318, 320, and 322 are connected to the notice antenna control unit 331.

Vehicle type detection apparatuses 362, 364, and 366 (which correspond to the vehicle type detection system 360 shown in FIG. 2), each being composed of a CCD line scanner, are disposed in the vicinity of the arch 316. The pair of vehicle type detection apparatuses 362 are intended to identify the type of a vehicle traveling along the lane 302 and are disposed on the ground 308 and the separation zone 310 so as to sandwich the lane 302 therebetween. Likewise, the pair of vehicle type detection apparatuses 364 are intended to identify the type of a vehicle traveling along the lane 304 and are disposed on the separation zone 310 and the separation zone 312 so as to sandwich the lane 304 therebetween. Further, the pair of vehicle type detection apparatuses 366 are intended to identify the type of a vehicle traveling along the lane 306 and are disposed on the separation zone 312 and the separation zone 314 so as to sandwich the lane 306 therebetween. These vehicle type detection apparatuses 362, 364, and 366 constitute the vehicle type detection system 360. The vehicle type detection system 360 is connected to the local controller 380, identifies the type of a passing vehicle from the vehicle's silhouette, which is obtained by processing an image obtained via the CCD line scanners, and transmits the thus identified type of vehicle to the local controller 380.

On the downstream side of the arch 316 in the vehicle traveling direction, an arch 340 is disposed between the ground 308 and the ground 314 such that it extends over the lanes 302, 304, and 306. Tollgate antennas 342, 344, and 346 (which correspond to the tollgate antenna 341 shown in FIG. 2) are disposed on the arch 340. The tollgate antenna 342 is for radio communication regarding a toll with a vehicle traveling along the lane 302 and is located above the lane 302. Likewise, the tollgate antenna 344 is for radio communication regarding a toll with a vehicle traveling along the lane 304 and is located above the lane 304. Further, the tollgate antenna 346 is for radio communication regarding a toll with a vehicle traveling along the lane 306 and is located above the lane 306. These tollgate antennas 342, 344, and 346 are connected to the tollgate antenna control unit 332.

Toll payment boxes 324, 326, and 328 (which correspond to the manual toll collection system 323 shown in FIG. 2) are disposed at the exit gate 300 for a vehicle whose driver pays a toll manually because the vehicle is not equipped for automatic toll collection. The toll collection box 324 for the lane 302 is disposed on the separation zone 310 in the vicinity of its downstream end in the vehicle traveling direction, such that it is situated at the side facing the lane 302. Likewise, the toll collection box 326 for the lane 304 is disposed on the separation zone 312 in the vicinity of its downstream end in the vehicle traveling direction, such that it is situated at the side facing the lane 304. Further, the toll collection box 328 for the lane 306 is disposed on the ground 314 in the vicinity of its downstream end in the vehicle traveling direction, such that it is situated at the side facing the lane 306. Each of these toll collection boxes 324, 326, and 328 is provided with a microcomputer (not shown). These toll collection boxes 324, 326, and 328 constitute the manual toll collection system 323 which is connected to the local controller 380 (FIG. 2). The local controller 380 collectively controls the microcomputers to manage information regarding manually collected tolls.

As will be described in detail later, the manual toll collection system 323 also functions as a recovery gate which is used when a communication error occurs. In such a case, the recovery gate is used for exchanging data using a control card and for collecting a toll. Each of the toll collection boxes 324, 326, and 328 of the manual toll collection system 323 is equipped with an IC card read-write unit 61C (FIG. 2), which accepts the IC card 62 to read data therefrom or write data thereinto. The IC card read-write apparatuses 61C are connected to the central computer 400.

Each of the IC card read-write apparatuses 61A, 61B, and 61C is equipped with an insertion detection unit which is composed of a limit switch and a photointerrupter for detecting insertion of the IC card 62.

On the downstream side of the toll collection boxes 324, 326, and 328, cameras 352, 354, and 356 for the lanes 302, 304, and 306 are disposed so as to photograph a payment offense vehicle. The cameras 352, 354, and 356 constitute the payment offense vehicle photographing system 350 (FIG. 2), which is connected to the local controller 380.

Traffic signals 334, 336, and 338 corresponding to the lanes 302, 304, and 306, respectively, are disposed on the downstream side of the arch 340 in the vehicle traveling direction so as to indicate whether or not a corresponding lane is available for go. These traffic signals 334, 336, and 338 are connected to the exit gate control center 330 and under control thereof tell a driver (for example, by lighting a green light) that a corresponding lane is available for go or tell a driver (for example, by lighting a red light) that a corresponding lane is not available for go.

The exit gate control center 330 is connected to the central computer 400 (FIG. 2). The exit gate control center 330 may be an independent control system without being connected to the central computer 400.

The on-vehicle device 30, and the on-road device used for communication with the on-vehicle device 30 will now be described. The description will refer to the on-road device provided at the entrance gate 100. To make the description simple, reference is also made to the entrance antenna 118, which is provided for radio communication with a vehicle traveling along the lane 102, and the entrance antenna control unit 132.

Figure 1:
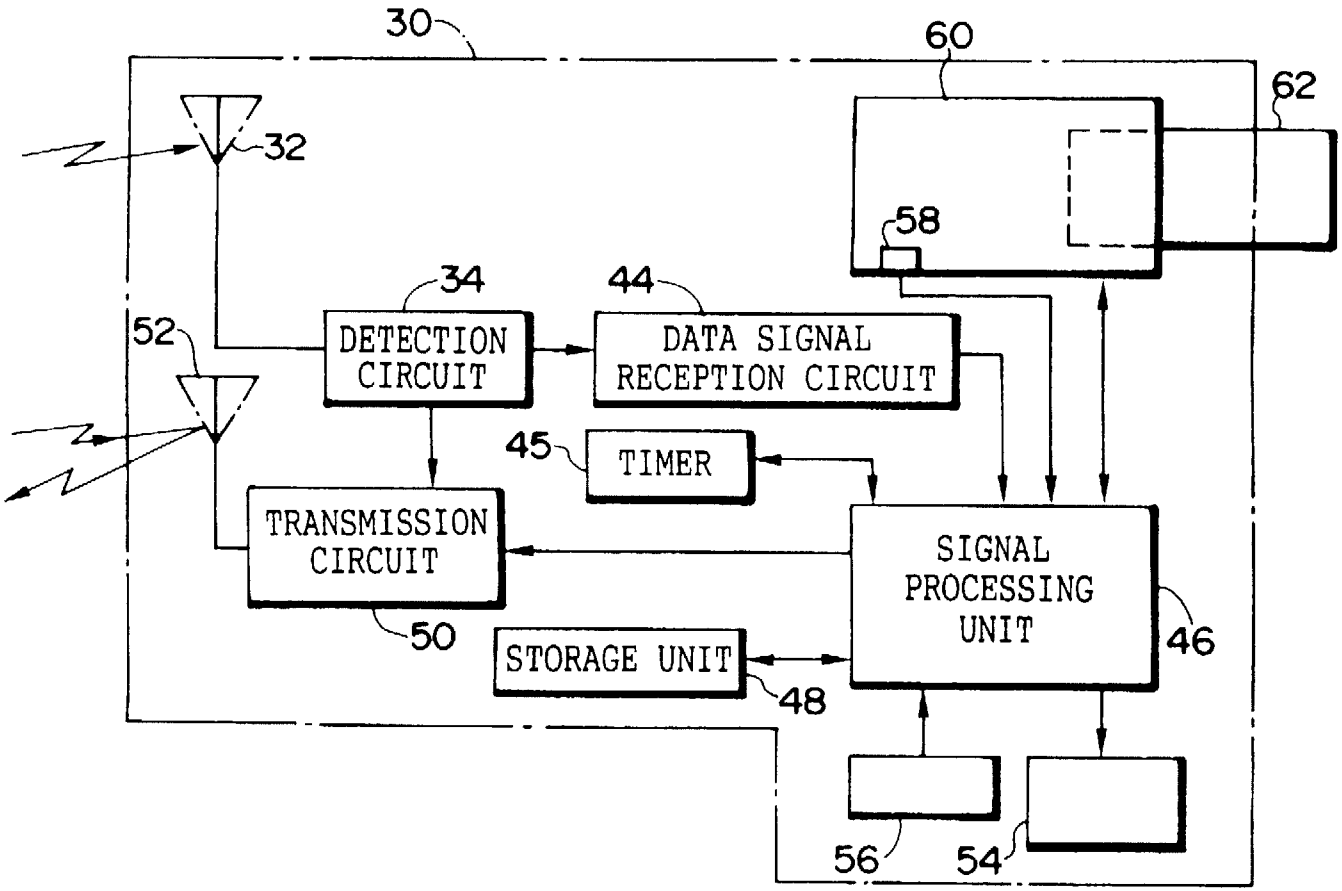
FIG. 1 is a block diagram illustrating an on-board device of an embodiment of the present invention.

As shown in FIG. 1, the on-vehicle device 30 has a reception antenna 32 for receiving a data signal from the on-road device. The reception antenna 32 is connected to a detection circuit 34 which detects a modulated wave received by the reception antenna 32 to thereby obtain the data signal. The detection circuit 34 is also connected to a transmission circuit 50 so as to obtain the carrier of a radio wave transmitted from the on-road device. The detection circuit 34 is connected via a data signal reception circuit 44 to a signal processing unit 46 which contains a microcomputer. The microcomputer contains a processing program, which will be described below.

A storage unit 48 serving as a storage means is connected to the signal processing unit 46. When the on-vehicle device 30 is installed on a vehicle, a vehicle number (identical to a license number) serving as an ID code and information regarding the type of the vehicle are stored into the storage unit 48. When an IC card serving as a general card is inserted into the on-vehicle device 30, information regarding the card value balance (the latest balance, for example, after the IC card has been used at a service area or the like along a toll road) is stored into the storage unit 48. Further, when a vehicle passes through an entrance gate, a vehicle type code detected at the entrance gate and the entrance information (entrance number, date on which the vehicle passed through the entrance gate, etc.) are stored into the storage unit 48. Also, when a vehicle passes through a check barrier, information regarding the check barrier (check barrier number, date on which the vehicle passed through the check barrier, etc.) is stored into the storage unit 48. In addition, when a communication error occurs, the communication error information [type of error, place of occurrence of error (type of gate, gate number, antenna number, etc.), date of occurrence of error, number of errors, etc.] is stored into the storage unit 48.

A transmission circuit 50 is connected to the signal processing unit 46. The transmission circuit 50 transmits as an answer signal a data signal which contains the ID code, to the on-road device via a transmission antenna 52. The on-vehicle device 30 detects a modulated wave received by the reception antenna 32 to obtain a carrier, and modulates the carrier using the data signal from the signal processing circuit 46. The thus modulated carrier is returned to the on-road device via the transmission antenna 52. The transmission antenna 52 may function as a transmission-reception antenna. In this case, an unmodulated carrier transmitted from the on-road device may be received by the transmission antenna 52, and the transmission circuit 50 may modulate the received unmodulated carrier using the data signal from the signal processing unit 46. The thus modulated carrier may be returned to the on-road device via the transmission antenna 52.

An IC card read-write unit 60 is connected to the on-vehicle device 30 so as to read data from an IC card 62 serving as a general card or a control card, and to write data thereinto. The IC card read-write unit 60 is equipped with a limit switch 58 for mechanically detecting insertion of the IC card 62. Whether or not the IC card 62 is inserted may be optically detected by a photointerrupter, which is composed of a light emitting element and a light receiving element, both being disposed opposite to each other, so as to detect whether or not a light beam existing between the elements is interrupted by the inserted IC card 62.

Connected to the signal processing unit 46 are a display 54 composed of an LCD or a CRT for displaying whether or not the IC card 62 is inserted and other information including the card value balance and a ten-key pad 56 for inputting a signal to the signal processing unit 46.

The signal processing unit 46 of the on-vehicle device 30 is connected to a battery installed in a vehicle via a power compensating circuit (not shown) and an ignition switch. The power compensating circuit outputs a signal to the signal processing unit 46 when it is predicted that proper radio communication will be difficult to make due to power supply from the battery being less than a predetermined value.

Figure 6:
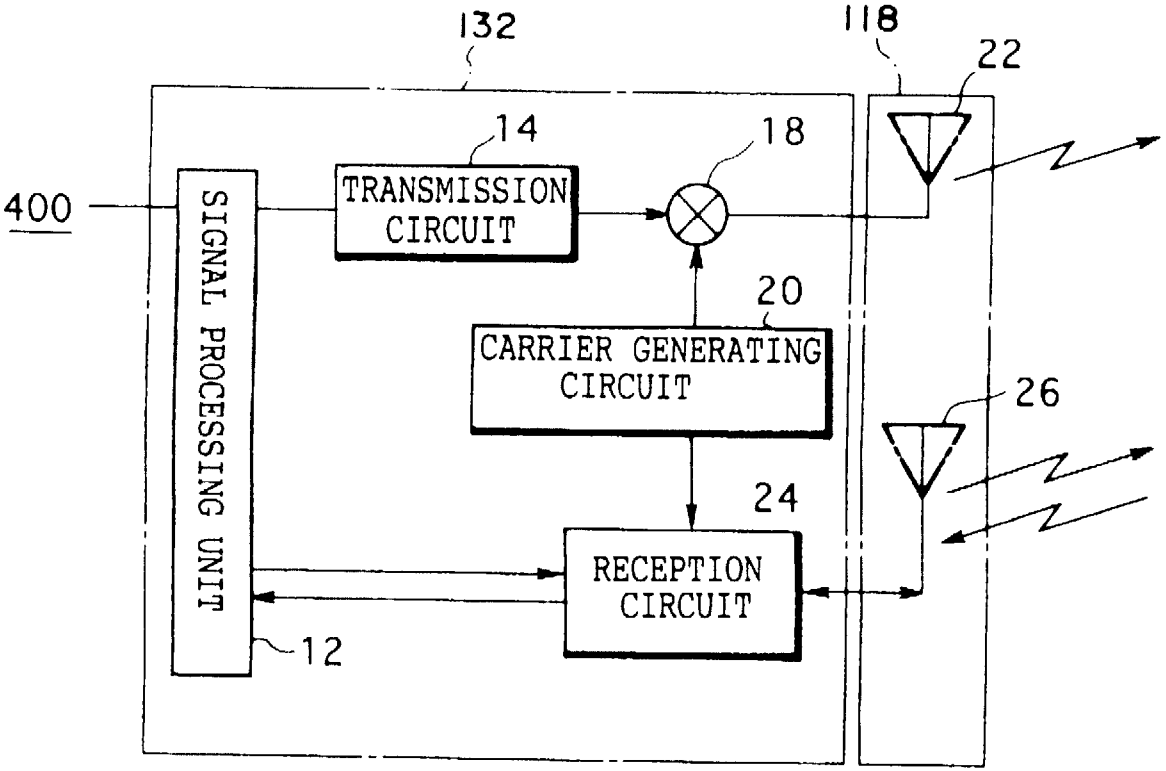
FIG. 6 is a block diagram illustrating an on-road device.

As shown in FIG. 6, the on-road device provided for radio communication with a vehicle traveling along the lane 102 is composed of the entrance antenna 118 and the entrance antenna control unit 132. The entrance antenna 118 is composed of a transmission antenna 22 and a reception antenna 26. The entrance antenna control unit 132 has a signal processing unit 12 which includes a microcomputer. The microcomputer stores therein a processing program described below. The signal processing unit 12 can be connected to the central computer 400. The signal processing unit 12 is connected to a transmission circuit 14 which generates a data signal (communication request signal) which includes an instruction. The transmission circuit 14 is connected to the transmission antenna 22 via a mixer 18. A carrier generating circuit 20 for generating a carrier having a predetermined frequency is connected to the mixer 18. The mixer 18 mixes a signal input from the transmission circuit 14 and a carrier input from the carrier generating circuit 20, thereby modulating the carrier using the signal. The thus modulated wave is transmitted from the transmission antenna 22.

A reception circuit 24 is connected to the carrier generating circuit 20. The reception circuit 24 extracts a data signal from a modulated wave which is returned from the on-vehicle device 30 shown in FIG. 1 and received by the reception antenna 26. The reception circuit 24 is connected to the signal processing unit 12. The reception circuit 24 is also connected to the carrier generating circuit 20 so as to input the carrier which has been transmitted to the on-vehicle device 30. This carrier is compared with the carrier contained in a signal returned from the on-vehicle device 30.

Other entrance antennas at the entrance gate 100 have a structure similar to that described above, and hence the description of their structures is omitted. In addition, an antenna and an antenna control unit provided at each of the check barrier 200 and the exit gate 300 have a structure substantially similar to that described above, and hence the description of their structures is also omitted.

In each of the on-vehicle device and the on-road device described above, a transmission antenna and a reception antenna are separately provided. However, the transmission antenna and the reception antenna may be integrated into one flat antenna.

A processing routine of each of the on-vehicle device 30 and the on-road device of the present embodiment will next be described. FIG. 8 shows the detail of step 402 in the processing routine of the on-vehicle device 30 shown in FIG. 7. If it is judged in step 500 that an inquiry signal has been received from the on-road device, then in step 502, the on-vehicle device 30 modulates the inquiry signal as a carrier in accordance with the ID code of the vehicle and transmits the thus modulated signal to the on-road device as an answering signal.

If it is judged in step 504 that a signal has been received from the on-road device, then in step 506, it is judged whether or not the received signal includes an entrance gate number, so as to judge whether or not the vehicle is traveling through the entrance gate 100. If it is judged in step 506 that the vehicle is not traveling through the entrance gate 100, then processing proceeds to step 508. If it is judged in step 506 that the vehicle is traveling through the entrance gate 100, then in step 510, an entrance gate process is performed. According to the entrance gate process in step 510, the entrance gate number contained in the signal received in step 506 is stored as the entrance data into the storage circuit 48 of the on-vehicle device 30.

In step 508, it is judged whether or not the signal received in step 506 includes a check barrier code indicative of the check barrier 200, thereby determining whether or not the vehicle is traveling through the check barrier 200. If it is judged in step 508 that the vehicle is not traveling through the check barrier 200, then in step 512, a check barrier process is performed. If it is judged in step 508 that the vehicle is not traveling through the check barrier 200, then it is judged that the vehicle is traveling through the exit gate 300, and in step 514, an exit gate process is performed. According to the check barrier process in step 512, the check barrier code contained in the signal received in step 506 is stored as the check barrier information into the storage unit 48 of the on-vehicle device 30. According to the exit gate process in step 514, a toll for traveling along a route judged by the entrance gate 100, the check barrier 200, and the exit gate 300 is calculated based on the vehicle type information stored in the on-vehicle device 30, the card value balance stored in a general card inserted in the on-vehicle device 30, and a toll table which was previously recorded into the on-vehicle device 30. The thus calculated amount of money is automatically subtracted from the current card value balance, thereby collecting the toll. After the toll is normally collected, the entrance information is cleared from the on-vehicle device 30.

Figure 10:
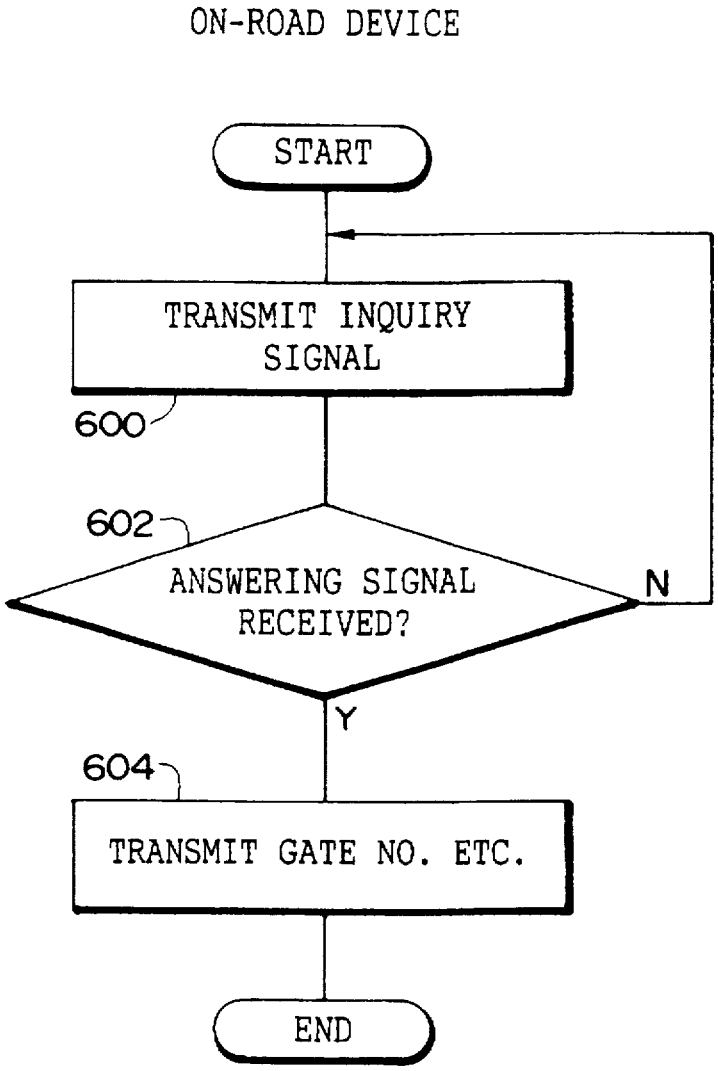
FIG. 10 is a flowchart illustrating a processing routine of the on-road device.

As shown in FIG. 10, in step 600, the on-road device disposed at the entrance gate 100 keeps transmitting an inquiry signal composed of continuous waves until it receives an answering signal from the on-vehicle device 30. If it is judged in step 602 that the answering signal is received from the on-vehicle device 30, then in step 604, the on-road device transmits to the on-vehicle device 30 a signal which includes the entrance gate number and the like.

The on-road device disposed at the check barrier 200 performs a process substantially similar to that performed by the above-mentioned on-road device disposed at the entrance gate 100. However, in step 604, the on-road device at the check barrier 200 transmits a signal which includes the check barrier code indicative of the check barrier 200 and the like, in place of a signal which includes the entrance gate number and the like.

At the exit gate 300 are disposed the on-road device DA (FIG. 2) composed of the notice antenna 317 and the notice antenna control unit 331 and the on-road device DB (FIG. 2) composed of the tollgate antenna 341 and the tollgate antenna control unit 332. Performing a process substantially similar to that described above, the on-road device DA, in step 604, transmits a signal which includes the exit code indicative of the exit gate 300 and the like. The on-road device DB, in step 604, transmits a signal which includes the exit code indicative of the exit gate 300, and collects a toll through radio communication.

Figure 9:
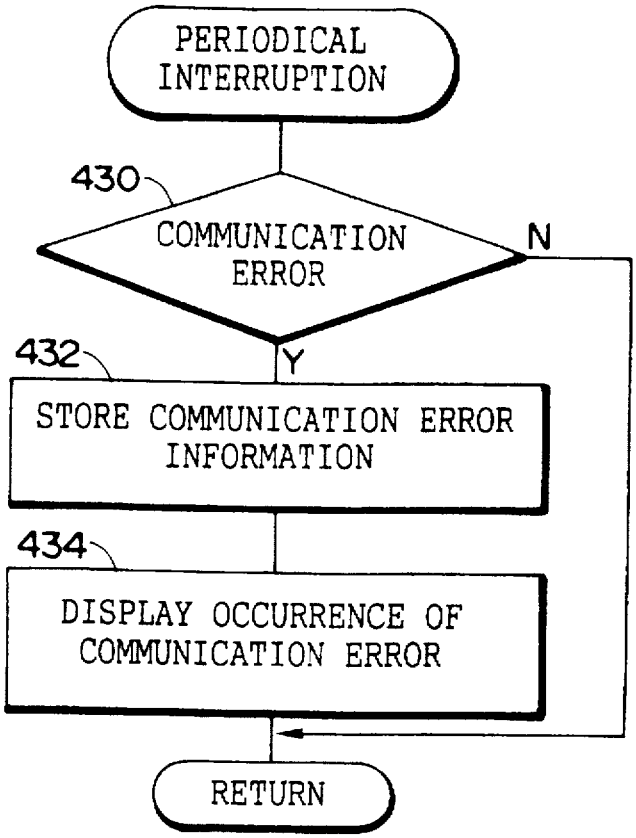
FIG. 9 is a flowchart illustrating an interruption processing routine which is executed in the on-vehicle device at predetermined intervals.

FIG. 9 shows an interruption routine which is executed in the on-vehicle device 30 at prejudged intervals of time. In step 430 it is judged whether or not a communication error has been recorded in the storage unit 48 of the on-vehicle device 30, so as to judge whether or not a communication error has occurred. If it is judged in step 430 that a communication error has occurred, then in step 432, information regarding the communication error is stored into the storage unit 48. Then in step 434, the occurrence of the communication error is displayed on the display 54, thereby instructing the driver to drive to a recovery gate or the like.

The communication error occurs at least either in the on-vehicle device 30 or the on-road device and is either a transmission error or a reception error from the viewpoint of radio communication. The on-vehicle device 30 suffers a transmission error in any of the following cases: the on-vehicle device 30 malfunctions due to breakage of the internal circuit, breakage of the antenna, an insufficient power supply from an on-board battery, or the like, and hence the normally operating on-road device fails to receive a radio signal from the on-vehicle device 30; the on-road device malfunctions, and hence it fails to receive a radio signal from the normally operating the on-vehicle device 30; or both the on-vehicle device 30 and the on-road device malfunction.

The on-vehicle device 30 suffers a reception error in any of the following cases: the on-vehicle device 30 malfunctions, and hence the on-vehicle device 30 fails to receive a radio signal from the normally operating on-road device; the on-road device does not transmit a normal radio signal due to its malfunction, and hence the normally operating on-vehicle device 30 fails to receive a radio signal from the on-road device; or both the on-vehicle device 30 and the on-road device malfunction.

By equipping the on-vehicle device 30 with a detection circuit such as a compensating circuit and a power insufficiency detection circuit, the malfunction of the on-vehicle device 30 can be detected by means of the detection circuit, whereby a communication error due to the malfunction of the on-vehicle device 30 can be detected. When there is a potential communication error due to insufficient power supply, the on-vehicle device 30 is adapted to transmit to the on-road device a code indicative of insufficient power supply and to receive a communication error judgment signal, which indicates the code indicating insufficient power supply is normally received from the on-road device. In step 430, a communication error is detected based on the communication error judgment signal received from the on-road device.

When the on-road device malfunctions, it is not possible to inform the on-vehicle device 30 of the occurrence of a communication error by means of radio communication only. In this case, a driver is informed of the occurrence of a communication error via the display 54, whereby the driver is instructed to drive to the recovery gate. In addition, the driver presses a prejudged key on the ten-key pad 56 to enter a signal indicative of the communication error. In response to this, an affirmative judgment is made in step 430 to proceed to steps 432 and 434, thereby storing a code indicative of the communication error as the communication error information into the storage unit 48.

Types of communication errors and the communication error information to be stored further include the following:

(1) Communication has been interrupted at a certain gate, and in addition, communication does not resume even after the elapse of a prejudged time since the interruption. In this case, the place where and the date when the communication error has occurred are stored as the communication error information.

(2) Communication at the check barrier 200 has revealed that entrance information has not been stored in the on-vehicle device 30. This is mainly caused by a failure to receive the entrance information at the entrance gate 100 due to a communication error. In this case, the check barrier information is stored, and in addition, the place where and the date when the communication error has occurred are stored as the communication error information.

(3) It is found at the exit gate 300 that the entrance information or the expected route information is not stored. This is mainly caused by a failure to receive the entrance information or the check barrier information due to a communication error at the entrance gate 100 or the check barrier 200. In this case, the exit information is stored, and in addition, the place where and the date when the communication error has occurred are stored as the communication error information.

(4) It is found at the entrance gate 100 that the previous entrance information is not cleared. This is mainly because an exit process such as the clearing of the entrance information was not performed at the previous exit gate 300 due to a failure to receive the exit information there. In this case, the previous entrance information and check barrier information are copied into a prejudged storage area of the storage unit 48 while the previous entrance information and check barrier information and information regarding the present entrance gate 100 where and the date when the anomaly has been found are stored as the communication error information.

(5) When the on-road device and the on-vehicle device 30 are checked for a prejudged certification code, a certification error has occurred. In this case, the place where and the date when the error has occurred is stored as the communication error information.

When the above-mentioned communication error information is stored, i.e. when the expected information is not stored, even though the on-vehicle device 30 itself is normal, the situation is abnormal. In this case, as will be described later, when the communication error information is cleared, the on-board device 30 is restored to its normal state.

When the occurrence of a communication error is displayed on the display 54, a driver drives to a manned gate such as the toll collection box or the recovery gate, each being equipped with the IC card read-write unit, or to a control office. An operator at the manned gate or the control office verbally inquires of the driver why he/she drives there. If the operator finds that the driver has merely taken the wrong path, the operator will direct the driver properly. If a communication error is the case, the operator will attempt communication again or operate the on-vehicle device 30 to check for any anomaly. When the on-vehicle device 30 is not installed in a vehicle, a toll is manually collected at the toll collection box. When the on-vehicle device 30 is normal, a toll is collected automatically or via the IC card 62.

Figure 11:
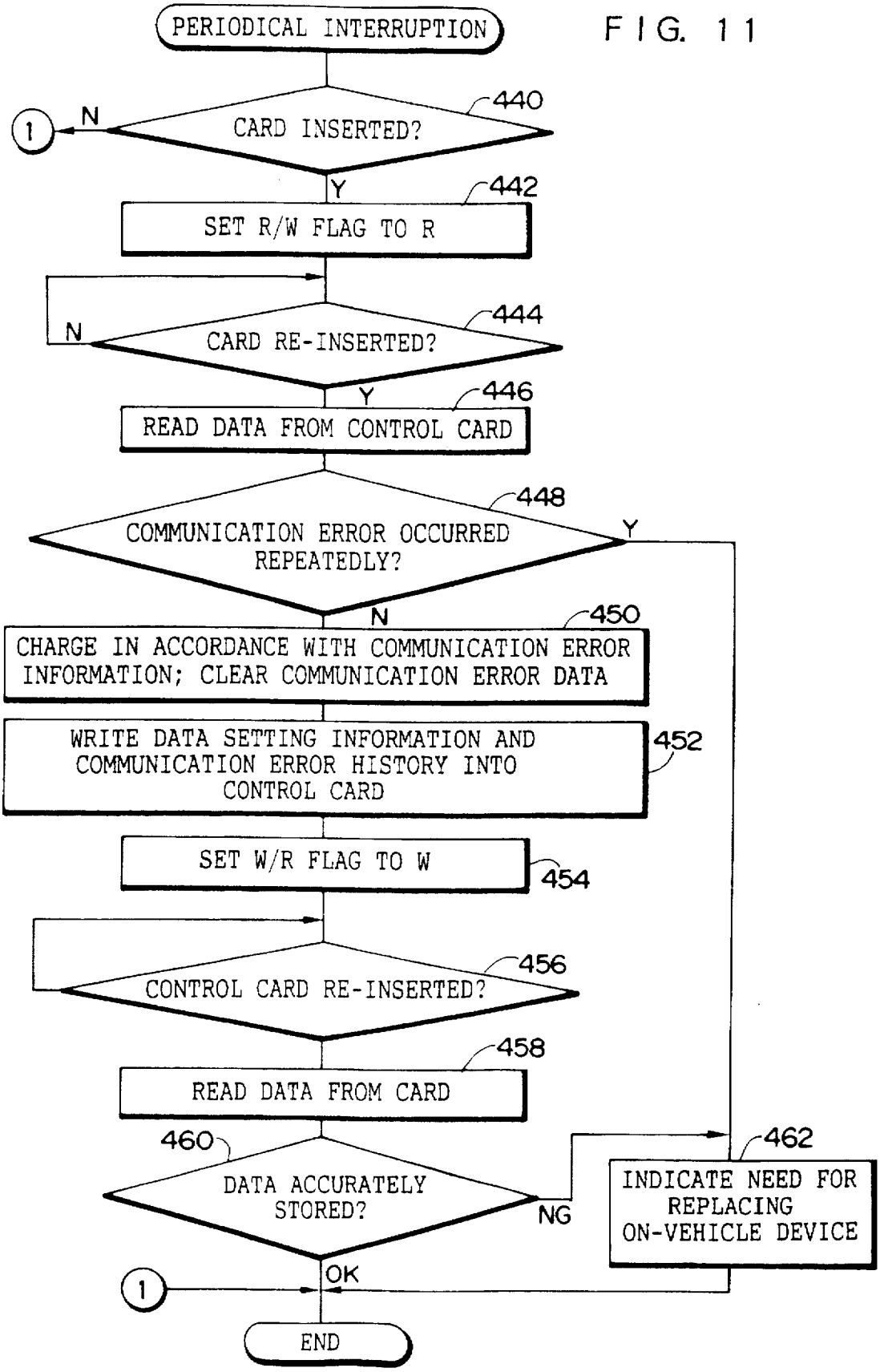
FIG. 11 is a flowchart illustrating an interruption processing routine which is executed in the on-road device at predetermined intervals.
Figure 12:
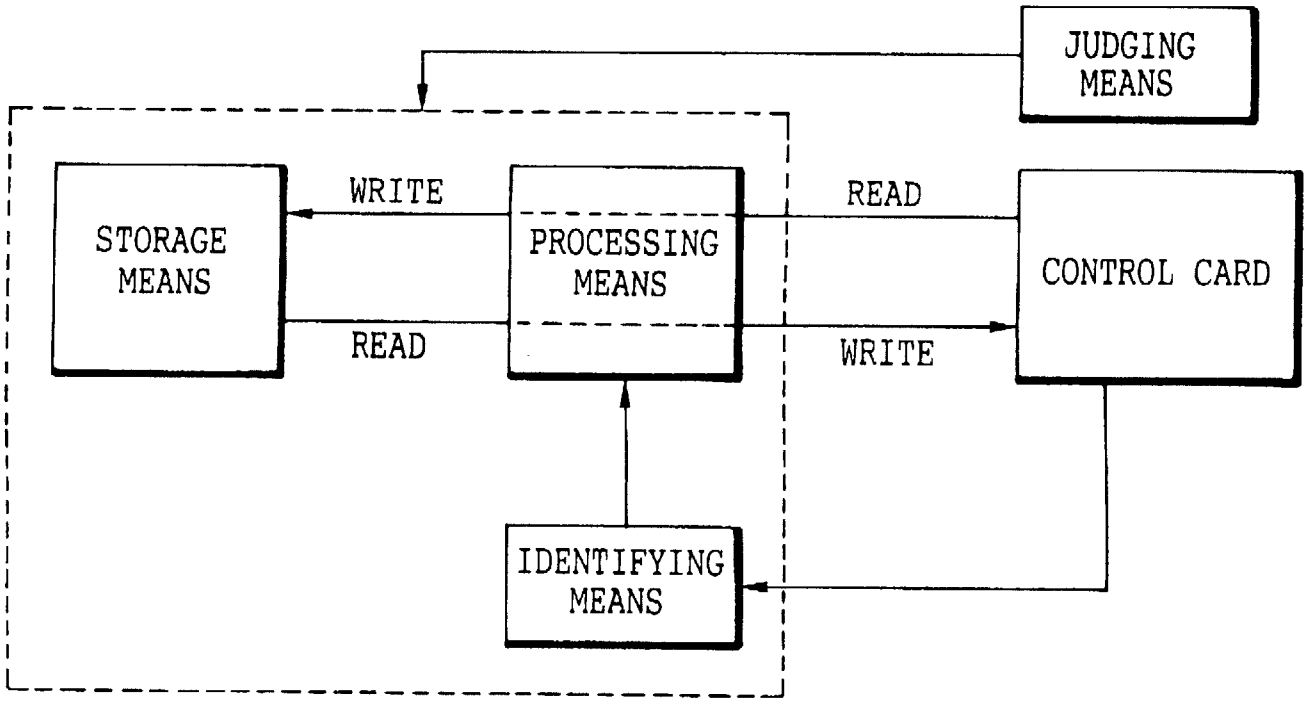
FIG. 12 is a block diagram illustrating the main structure of the present invention.

When the on-vehicle device 30 is abnormal, a control card is inserted into the IC card read-write unit of the on-road device. FIG. 11 shows an interruption routine which is executed in the on-road device at prejudged intervals of time. In step 440, it is judged whether or not the control card has been inserted into the IC card read-write unit, based on the result of detection by a card detector. If it is judged in step 440 that the control card has been inserted, then in step 442, the R/W flag is set to R. Then, the control card is removed from the IC card read-write unit. The removed control card is passed to the driver, who then inserts it into his on-vehicle device 30. R in the R/W flag means reading data from the storage unit 48 and storing the read data into the work area in the control card. W in the R/W flag means reading data from the work area in the control card and writing the read data into the storage unit 48. By contrast, R may be defined as reading data from the work area in the control card and writing the read data into the storage unit 48, and W may be defined as reading data from the storage unit 48 and storing into the work area in the control card. Further, both a location to write into and a location to read from may be prejudged. Thus, data may be read from a prejudged location in the work area of the control card, and the read data may be written into a predetermined location in the storage unit 48. Also, data may be read from a predetermined location in the storage unit 48, and the read data may be written into a predetermined location in the work area of the control card.

As will be described later, a driver inserts the control card into his on-vehicle device 30 so as to write data stored in the storage unit 48 into the control card, and hand it to an operator. The operator receives the control card from the driver and then inserts it again into the IC card read-write unit.

In step 444, it is judged whether or not the control card has been re-inserted into the IC card read-write unit. If it is judged in step 444 that the control card has been re-inserted, then in step 446, data is read from the control card because the R/W flag is set to R. In step 448, the number of communication errors is judged based on the communication error information. If it is judged in step 448 that communication errors have occurred repeatedly, then in step 462, a message is displayed on the on-road device, indicating the need for replacing the on-vehicle device 30. In this case, because communication errors have occurred repeatedly in the on-vehicle device 30, it can be judged that at least any one of the reception antenna 32, the transmission antenna 52, the detection circuit 34, the data signal reception circuit 44, and the transmission circuit 50 in the on-vehicle device 30 is abnormal.

In step 450, at the toll collection box, a toll is automatically collected in accordance with the communication error information, and then the communication error information is cleared. In step 452, the information expected to be stored, i.e. the information which could not be received due to a communication error described above in (1) to (5), and the communication error history information indicative of the history of communication errors are written into the control card. By contrast, at the check barrier 200, the communication error information is cleared without collecting a toll, and the information which could not be received due to a communication error, and the communication error history information indicative of the history of communication errors are written into the control card.

The information expected to be stored includes the entrance information indicative of the entrance gate 100 through which a vehicle travels into the toll road, the route information (check barrier information) indicative of the check barrier 200 located along the toll road, the card value balance information and the like, the exit information indicative of the exit gate 300, and the charge information indicative of a charge or toll to be paid at a parking lot, the entrance gate 100, or the exit gate 300.

Since data read by the on-road device is not sufficient for executing the above-mentioned automatic toll collecting process, it is necessary for an operator to ask a driver to show an issued entrance certificate, route certificate, and the like in order to calculate the traveled section based on these certificates. Alternatively, the traveled section may be estimated if possible. Based on the thus calculated or estimated traveled section, the operator asks the driver to pay in cash or using a general card. Although the automatic toll collecting process can be performed by inserting the general card into the IC card read-write unit, it may be carried out by performing again radio communication between the on-vehicle device 30 and the on-road device.

When the card value balance is found to be short of a charge, the operator notifies the driver of the shortage. The driver may pay the shortage in cash or using another general card. When another general card is presented, the operator sets the balance of the previous general card suffering the shortage to "O", and settles the shortage using the presented another general card.

As described above, according to the present embodiment, when a communication error occurs, information stored in the on-vehicle device 30 is written into the control card inserted into the on-vehicle device 30. Thus, even when radio communication is disabled between the on-road device and the on-vehicle device 30, it is possible to transmit information, which would otherwise be transmitted through radio communication, from the on-vehicle device 30 to the on-road device via the control card.

In step 454, the R/W flag is set to W. Then, the operator removes the control card from the IC card read-write unit of the on-road device and asks the driver to insert the removed control card into the on-vehicle device 30. As will be described later, after data stored in the control card is written into the storage unit 48 of the on-vehicle device 30, data stored in the storage unit 48 is written into the control card. Then, the driver passes the control card to the operator. The operator re-inserts the received control card into the IC card read-write unit.

In step 456, it is judged whether or not the control card has been re-inserted into the IC card read-write unit. If it is judged in step 456 that the control card has been re-inserted, then in step 458, data stored in the control card is read because the R/W flag is set to R in the on-vehicle device 30. In step 460, it is judged whether or not data stored in the control card has been accurately stored into the storage device 48 of the on-vehicle device 30. If it is judged in step 460 that the data has been accurately stored, then the on-road device is probably abnormal, and hence this routine is terminated in order to execute a not-shown routine for finding out an on-road device which may be abnormal.

If it is judged in step 460 that the data has not been accurately stored, then the data write system is probably abnormal, i.e. at least any of the signal processing unit 46, the IC card read-write unit 60, and the storage unit 48 is probably abnormal. Hence, in step 462, the driver is instructed to replace the on-vehicle device 30.

Figure 7:
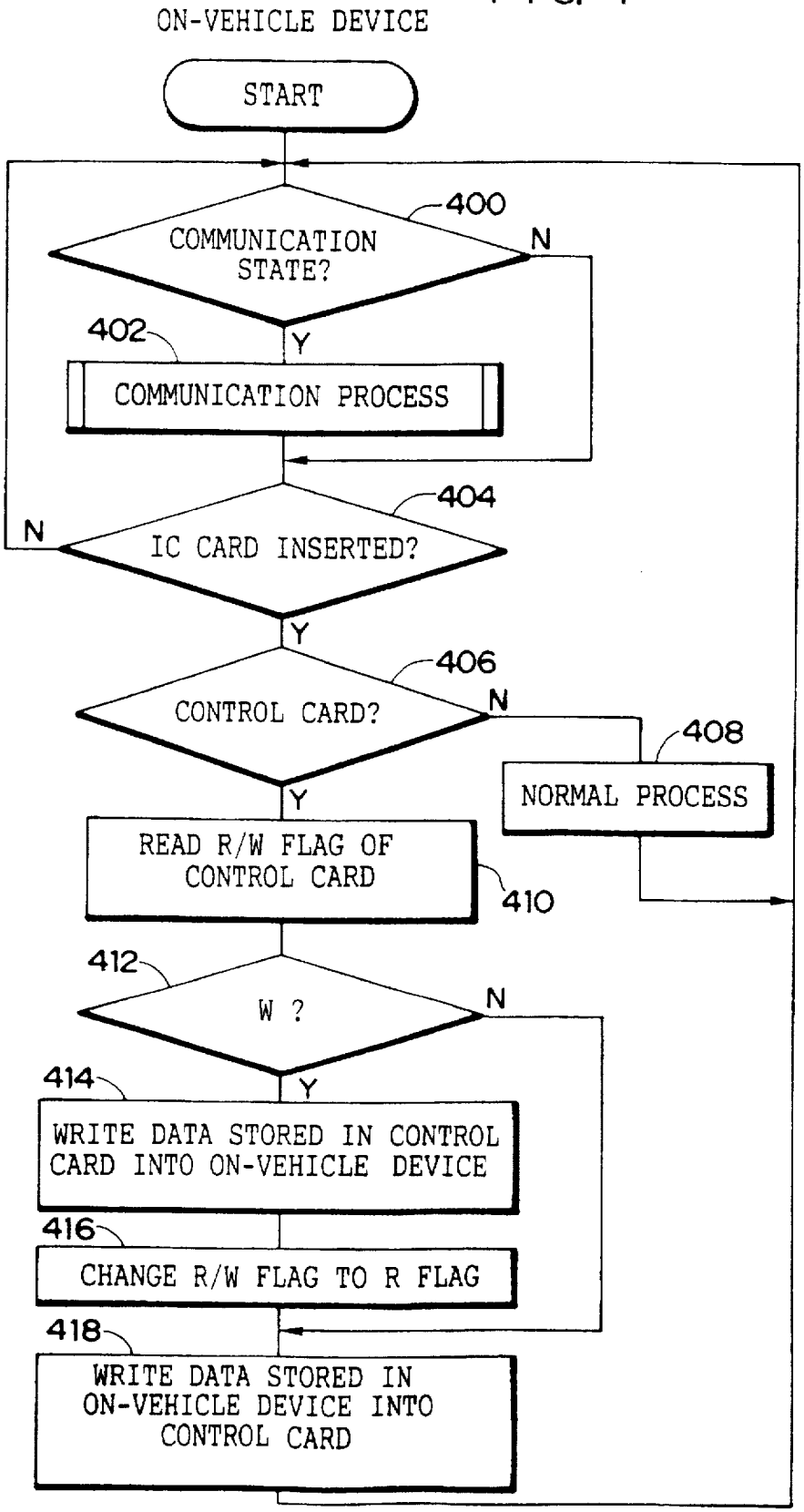
FIG. 7 is a flowchart illustrating a processing routine of the on-vehicle device.
Figure 8:
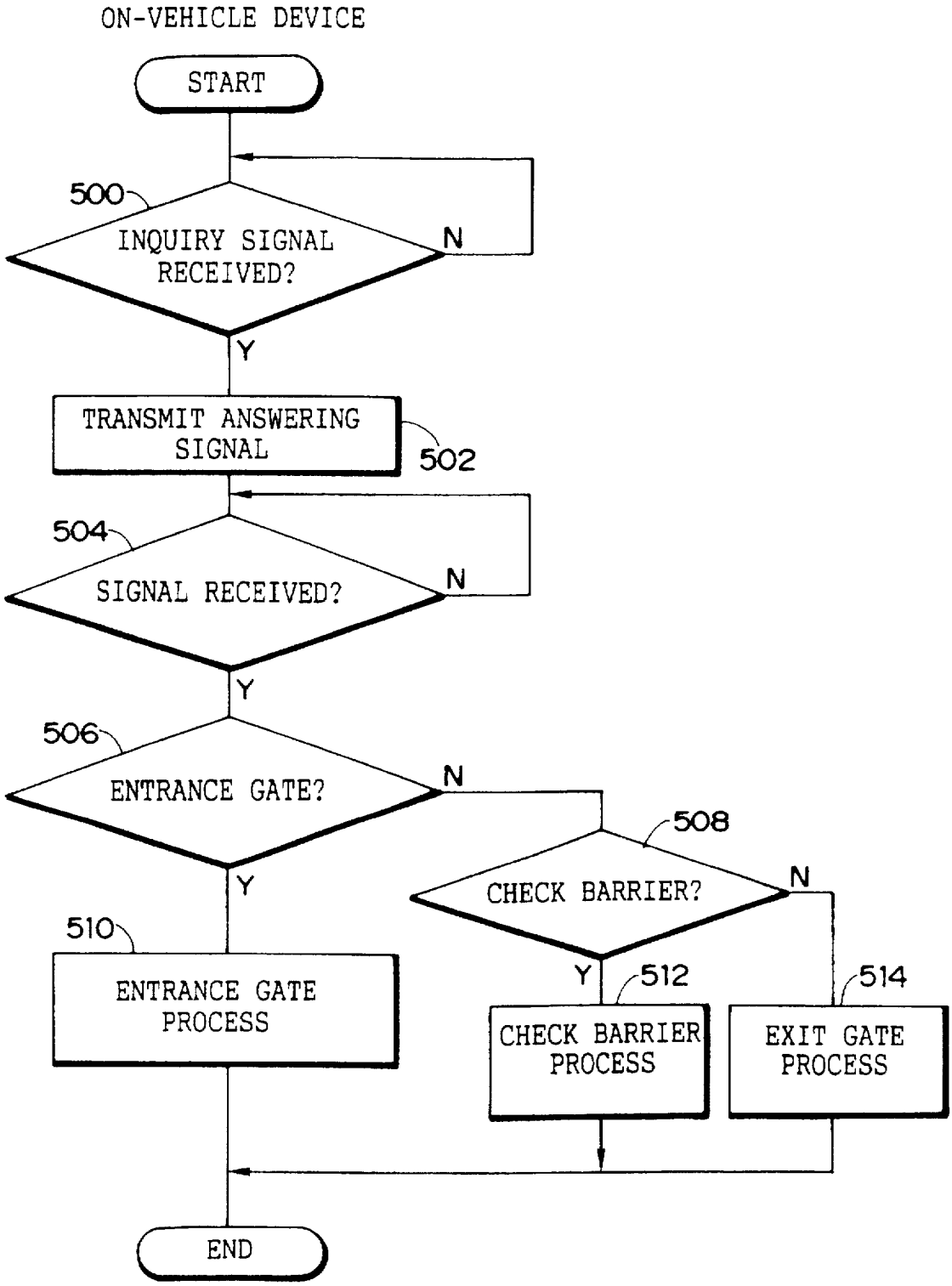
FIG. 8 is a flowchart illustrating the detail of step 402 of FIG. 7.

FIG. 7 shows a processing routine of the on-vehicle device 30. In step 400, whether or not the on-vehicle device 30 is in the communication state is judged. If it is judged in step 400 that the on-vehicle device 30 is in the communication state, then in step 402, the above-described communication process shown in FIG. 8 is executed.

In step 404, it is judged whether or not the state of the limit switch 58 has changed from OFF to ON, so as to judge whether or not the state indicative of absence of an IC card has changed to the state indicative of presence of an IC card, i.e. whether or not an IC card has been inserted. If it is judged in step 404 that the IC card has been inserted, then in step 406, the card type information is read from the IC card in order to judge whether the inserted IC card is a general card or a control card. Steps 404 and 406 correspond to judgment formed by the judging means of the present invention.

If it is judged in step 406 that the inserted IC card is a general card, then in step 408, an ordinary process is performed. If it is judged in step 406 that the inserted IC card is a control card, then in step 410, the R/W flag is read from the control card. In step 412 it is judged whether or not the read R/W flag is W, so as to judge whether or not the control card requires a data write. Steps 410 and 412 correspond to processing and judgment performed by the identifying means of the present invention.

Since the R/W flag is initially set to R, processing proceeds from step 412 to step 418. In step 418, data stored in the storage unit 48 of the on-vehicle device 30 is read, i.e. the vehicle type information, the license number, the card value balance, the vehicle type code detected at the entrance gate 100, the entrance information, the check barrier information, the communication error information, and the like are read from the storage unit 48. In addition, the read data is written into the work area of the control card.

If it is judged in step 412 that the R/W flag has been set to W, which indicates that the control card requires a data write, then in step 414, data stored in the work area of the control card (information expected to be stored) is read, and the read data is written into the storage unit 48 of the on-vehicle device 30. In step 416, the R/W flag is changed to R. Then, in step 418, data stored in the storage unit 48 of the on-vehicle device 30, which data includes the data having been read from the control card in step 414, is read, and the read data is written into the work area of the control card. Thus, information expected to be stored is written into the storage unit 48, thereby restoring the on-vehicle device 30 to the normal state.

Step 418 (to which processing proceeds when it is judged in step 412 that R has been set) and step 414 (to which processing proceeds when it is judged in step 412 that W has been set) correspond to processing performed by the processing means of the present invention.

As described above, data which has been copied from the control card to the on-vehicle device 30 is rewritten into the control card. Thus, by reading data from the work area of the control card, the on-road device can check (steps 458 and 460 shown in FIG. 11) the result of a data write from the control card to the on-vehicle device 30. Based on the result of this check, the on-road device can judge which is abnormal, the on-road device or the on-vehicle device 30. Further, since the on-road device can collect information regarding abnormality in the on-vehicle device 30, it is possible to prevent the same trouble from recurring. In addition, since the on-road device can check data stored in the on-vehicle device 30, it becomes easier to find the user's unfair practice. Thus, an operator in the manned gate and the control office can more effectively prevent wrongdoing.

In addition to usage at the exit gate 300, the control card can be used at the entrance gate 100 or the check barrier 200, where the control card is inserted into the IC card read-write unit of the on-road device so that data expected to be stored can be written into the control card.

According to the present embodiment, when a communication error occurs, data stored in the on-vehicle device is written into the control card so as to transmit the data to the on-road device. Thus, when the radio communication between the on-road device and the on-vehicle device is disabled, it is possible to transmit information, which would otherwise be transmitted through radio communication, between the on-vehicle device and the on-road device via the control card. Also, when there is a location where a communication error occurs, information can be transmitted via the control card between the on-road device and the on-vehicle device only at such locations, without affecting other locations. Therefore, in the automatic toll collecting system as a whole, data is smoothly transmitted through radio communication between the on-vehicle device and on-road devices.

While the present invention has been described with reference to its application to the automatic toll collecting system for a toll road, the present invention is not limited to this application. The invention may be applicable to a communication system intended to attain unmanned charging or guidance for a parking lot or the like and may prove itself to be effective in such an application. In such a parking lot, there is a possibility that not only a vehicle which makes a payment but also other vehicles which are different in duration of parking and the type are situated near a gate. In addition, some vehicles may not be equipped with the on-vehicle device.

When the present invention is applied to such a parking lot, time of entry into the parking lot may be contained as parking information in the information which is exchanged between the on-vehicle device and the on-road device. Also, the invention may be applicable to a communication system for guiding vehicles or for providing vehicles with information as well as for collecting charges.

What is claimed is:

1. An on-vehicle device for road-vehicle communication comprising:

storage means for storing data communicated via radio communication with an on-road device disposed on a road;

insertion means for enabling insertion of a control card having a storage portion for storing said data, and for also enabling insertion of a general card different than said control card;

judging means for judging whether said control card or said general card is inserted into said on-vehicle device;

identifying means for identifying whether said control card inserted into said on-vehicle device requests at least either a read of said data from said storage means or a write of said data into said storage portion of said control card or whether said control card inserted into said on-vehicle device requests at least either a write of said data into said storage means or a read of said data from said storage portion of said control card; and processing means for performing first processing so as to read said data from said storage means and write said read data into said storage portion of said control card when said judging means judges that said control card is inserted and said identifying means identifies that said control card requests at least either a read of said data from said storage means or a write of said data into said storage portion of said control card, for performing second processing so as to read said data from said storage portion of said control card and write said read data into said storage means when said judging means judges that said control card is inserted and said identifing means identifies that said control card requests at least either a write of said data into said storage means or a read of said data from said storage portion of said control card, and for performing third processing so as to process data stored by said general card when said judging means judges that said general card is inserted.

2. The on-vehicle device for road-vehicle communication according to claim 1, wherein said control card and said general card are IC cards.

3. An on-vehicle device for road-vehicle communication comprising:

storage means for storing data communicated via radio communication with an on-road device disposed on a road;

judging means for judging whether or not a control card having a storage portion for storing said data is inserted into said on-vehicle device;

identifying means for identifying whether said control card inserted into said on-vehicle device requests at least either a read of said data from said storage means or a write of said data into said storage portion of said control card or whether said control card inserted into said on-vehicle device requests at least either a write of said data into said storage means or a read of said data from said storage portion of said control card;

processing means for performing first processing so as to read said data from said storage means and write said read data into said storage portion of said control card when said control card requests at least either a read of said data from said storage means or a write of said data into said storage portion of said control card, and for performing second processing so as to read said storage means when said control card requests at least either a write said data into said storage means or a read of said storage portion of said control card; and communication error judgement means for judging whether a communication error has occurred between said on-road device and said on -vehicle device, and when it is jufged by said communication error judgement means that a communication error has occurred, information regarding said communication error is stored in said storage means.

4. The on-vehicle device for road-vehicle communication according to claim 3, wherein said on-vehicle device further comprises a display unit, and when it is judged by said communication error judgment means that a communication error has occurred, the occurrence of the communication error is displayed on said display unit.

5. The on-vehicle device for road-vehicle communication according to claim 3, wherein said communication error judgment means performs at predetermined intervals the judgment on occurrence of a communication error.

6. An on-vehicle device for road-vehicle communication comprising:

storage means for storing data communicated via radio communication with an on-road device disposed on a road;

insertion means for enabling insertion of a control card having a storage portion for storing said data, and for also enabling insertion of a general card different than said control card;

judging means for judging whether said control card rather than said general card is inserted into said on-vehicle device;

identifying means for identifying whether said control card inserted into said on-vehicle device requests at least either a write of said data into said storage means or a read of said data from the storage portion of said control card; and processing means for performing first processing so as to read said data from said storage portion of said control card and write said read data into said storage means and then performing second processing so as to read said data stored in said storage means and write said read data into said storage portion of said control card, when said judging means judges that said control card is inserted and said identifying means identifies that said control card requests at least either a write of said data into said storage means or a read of said data from said storage portion of said control card.

7. The on-vehicle device for road-vehicle communication according to claim 6, wherein said control card and said general card are IC cards.

8. An on-vehicle device for road-vehicle communication comprising:

storage means for storing data communicated via radio communication with an on-road device disposed on a road;

judging means for judging whether or not a control card having a storage portion for storing said data is inserted into said on-vehicle device;

identifying means for identifying whether said control card inserted into said on-vehicle device requests at least either a write of said data into said storage means or a read of said data from the storage portion of said control card; and processing means for performing first processing so as to read said data from said storage portion of said control card and write said read data into said storage means and then performing second processing so as to read said data stored in said storage means and write said read data into said storage portion of said control card, when said control card requests at least either a write of said data into said storage means or a read of said data from said storage portion of said control card; and communication error judgment means for judging whether a communication error has occurred between said on-road device and said on-vehicle device, and when it is judged by said communication error judgment means that a communication error has occurred, information regarding said communication error is stored in said storage means.

9. The on-vehicle device for road-vehicle communication according to claim 8, wherein said on-vehicle device further comprises a display unit, and when it is judged by said communication error judgment means that a communication error has occurred, the occurrence of the communication error is displayed on said display unit.

10. The on-vehicle device for road-vehicle communication according to claim 8, wherein said communication error judgment means performs at predetermined intervals the judgment on occurrence of a communication error.

11. An on-vehicle device disposed in a vehicle that communicates via radio with an on-road device disposed on a road in a road-vehicle communication system, said road-vehicle communication system including a control card that is adapted to be removably inserted in said on-vehicle device and said on-road device, said on-vehicle device comprising:

a communication unit that exchanges data via radio communication with said on-road device;

a storage unit that stores said data;

a control card read-write unit that receives said control card and reads and writes said data from and to said control card when said control card is inserted in said on-vehicle device; and a processing unit that, when said data can not be successfully exchanged with said on-road device via radio communication, causes said data to be exchanged with said on-road device instead via said control card.

12. The on-vehicle device according to claim 11, further comprising:

a communication error detection unit that detects when a radio communication error has occurred between said on-vehicle device and said on-road device and stores information concerning said communication error in said storage unit.

13. A road-vehicle communication system, comprising:

a control card;

an on-road device disposed on a road, including:

a communication unit that is adapted to transmit and receive data via radio communication, and a control card read-write unit that receives said control card and reads data from and writes data to said control card when said control card is inserted in said on-road device; and an on-vehicle device, including:

a communication unit that is adapted to transmit and receive data via radio communication with said on-road device, a storage unit that stores said data, a control card read-write unit that receives said control card and reads and writes said data from and to said control card when said control card is inserted in said on-vehicle device, and a processing unit that, when said data can not be successfully exchanged with said on-road device via radio communication, causes said data to be exchanged with said on-road device instead via said control card.

* * * * *